United States Patent [19]

Richards

[11] Patent Number: 5,055,641

[45] Date of Patent: Oct. 8, 1991

[54] FLUID-FLOW-CONTROL-SWITCH VALVE

[76] Inventor: Gary H. Richards, 3204 Palm Ave., Manhattan Beach, Calif. 90266

[21] Appl. No.: 625,157

[22] Filed: Dec. 10, 1990

[51] Int. Cl.[5] ..... H01H 35/40

[52] U.S. Cl. ..... 200/81.9 M

[58] Field of Search ..... 200/81 R, 81.9 R, 81.9 M, 200/82 E, 81.9 HG, 82 R

[56] References Cited

U.S. PATENT DOCUMENTS

| | | | |
|---|---|---|---|
| 3,165,605 | 1/1965 | Dietz | 200/81.9 M |
| 3,368,045 | 2/1968 | Harper | 200/81.9 M |
| 3,551,620 | 12/1970 | Hoover | 200/83 L |
| 4,365,125 | 12/1982 | Keller | 200/81.9 M |
| 4,499,347 | 2/1985 | Richards | 200/81.9 M |

*Primary Examiner*—J. R. Scott

*Attorney, Agent, or Firm*—Francis X. LoJacono

[57] ABSTRACT

The invention consists of a combination fluid-control-switch valve adapted for monitoring water flow in water-supply systems so as to enable a purification or treatment system therein to operate as the water is being used. The valve comprises a two-section housing, wherein an upper section thereof defines a sealed switch compartment having a switch that is actuated by the movement of a magnet mounted to a pivot arm, and a lower independent section defining a flow chamber having an inlet port and an outlet port, and wherein a poppet valve is located in the flow chamber defined by a slidable valve stem that includes a calibrated washer for setting the flow rate of the water passing through the chamber, a back-flow plate preventing the treated water from becoming contaminated when the system is not in use. Attached to the valve stem is a second magnet that moves up and down with the valve stem and thereby causes the movement of the arm mounted magnet to engage the switch in the switch compartment so as to turn the switch on and off as required.

6 Claims, 2 Drawing Sheets

FLUID-FLOW-CONTROL-SWITCH VALVE

BACKGROUND OF THE INVENTION

1. Field of the Invention

The present invention relates generally to a flow-control valve and more particularly to a combination fluid-control-switch valve wherein a magnetically operated switch is incorporated therein which is activated by means of a second magnet mounted to a free-floating valve stem. The valve stem is slidably enclosed within the valve housing, wherein the valve stem includes means for calibrating the rate of flow of fluid in a downstream direction or through the outlet port thereof, and a valve plate to prevent back flow of fluid in an upstream direction or through the inlet port thereof.

2. Description of the Prior Art

There are presently in use many types of fluid-control valves having various control systems, as well as many valve configurations. As is often the case, however, many such fluid-control valves are restricted in their use and/or application.

More particularly, there exists a problem in providing a suitable means for monitoring and controlling the flow of water in a water-supply systems that work in cooperation with various water purification or treatment systems as they are being used. Water purification or treatment systems are commonly positioned downstream of a water-supply source. Water can be provided by any number of water sources, such as rural wells or holding tanks as some examples.

Thus, contaminated water from whatever water source must first be purified or oxygenated prior to its use. Contaminated water should flow only through a purification system during the operation of that system which should not be able to operate when the water flow to the purifier stops. Accordingly, there is a need for a simple valve mechanism that can be located just aft of the purifying apparatus and provide the capability of monitoring and controlling a predetermined flow rate. As is well known in the art, different treatment systems generally have different flow-rate requirements. Therefore, a flow switch with a relatively wide range of flow-rate settings is desirable.

There also exists the problem that when untreated water has been treated it may become polluted and/or diluted by yet untreated water upstream in the system. This problem must also be addressed. The applicant is not aware of a combination flow-control valve that includes means for a wide-range, flow-control switch in combination with a check valve so as not allow migration of the diffusion of untreated water into treated water.

There also exists the problem of being how to switch the current of a metering-pump motor or other relatively high amperage device with the currently available flow switch that will monitor flow rates in the low-fractional gallon range.

Examples of related prior art are shown in U.S. Pat. Nos. 3,239,625, to B. H. Clason: 3,297,843, to M. S. Hoss: 3,795,789, to Tulio Malzoni: 4,365,125, to G. D. Keller: 4,499,347, to G. H. Richards.

SUMMARY AND OBJECTS OF THE INVENTION

Many of the above problems can be controlled or eliminated by incorporating the present invention into most all water treatment systems. Accordingly, an important object of the present invention is to provide a combination flow switch and monitoring means that will allow for a relatively wide range of flow rates starting at fractions of a gallon per minute.

Still another object is to provide a valve arrangement that includes a magnetically operated switch that is activated by a second magnet that is mounted to a sliding valve stem which co-acts with the magnetically operated flow switch. This action will prevent contamination by the migrating untreated water, and subsequent commingling with the treated water, by means of a check valve that is incorporated within the valve stem. A pump motor as high as 2 hp. can be operated without the aid of a relay.

A further object of the invention is to provide a fluid-flow-control valve of this character that comprises a two section housing, wherein an upper housing defines a sealed compartment for the magnetically operated switch, and a lower sealed housing defines a water-flow chamber having a check valve that includes a calibrated washer that controls the flow of treated water in only one direction under a given flow-rate setting of the calibrated washer, so that the water flows into an inlet port and is diverted upward past the calibrated washer into the flow chamber. The flow rate is set by different diameters of the washer to obtain the desired restriction to allow the water flow to push the calibrated washer upwardly along with the valve stem or plunger, whereby the magnet attached to the rising valve stem repels the magnet located in the upper compartment thereof. This magnet is attached to a pivot arm that includes a protrusion or cam member thereon for engagement with the adjacent switch that activates the water-treating apparatus upstream of the valve.

It is still another object of the invention to provide a valve device of this character that can be used to open, close or divert an electric circuit which is basically activated by the flow of a fluid, and wherein the switch has no mechanical seal to break down and cause a leak between the valve-flow passage and the switch compartment.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjuction with the accompanying drawings and numbered parts, in which.

DESCRIPTION OF THE PREFERRED EMBODIMENT

Figure 3:
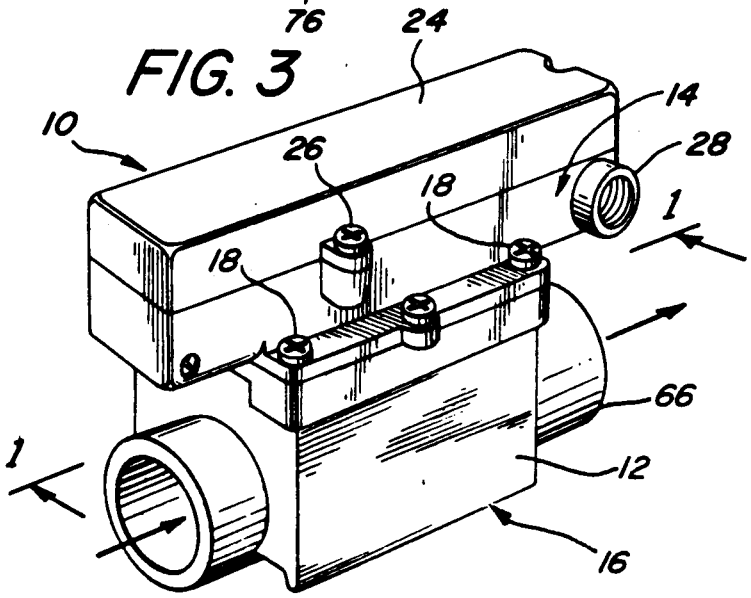
FIG. 3 is a perspective view of the present invention.

Referring more particularly to the drawing, there is shown a fluid-control-switch valve, generally indicated at 10, which comprises a housing, designated at 12, that defines upper and lower sections 14 and 16. Upper section 14 is isolated from lower section 16 and both sections are attached by suitable screw means 18. The upper section 14 defines a compartment 20 which is formed by an elongated box-like member 22 having a closure member 24 that is removably secured to member 22 by any suitable means, such as screws 26 seen in FIG. 3. A threaded nipple member 28 is formed in box member 22 whereby suitable wires can be received therethrough for connecting to the switch means, designated generally at 30.

Figure 1:
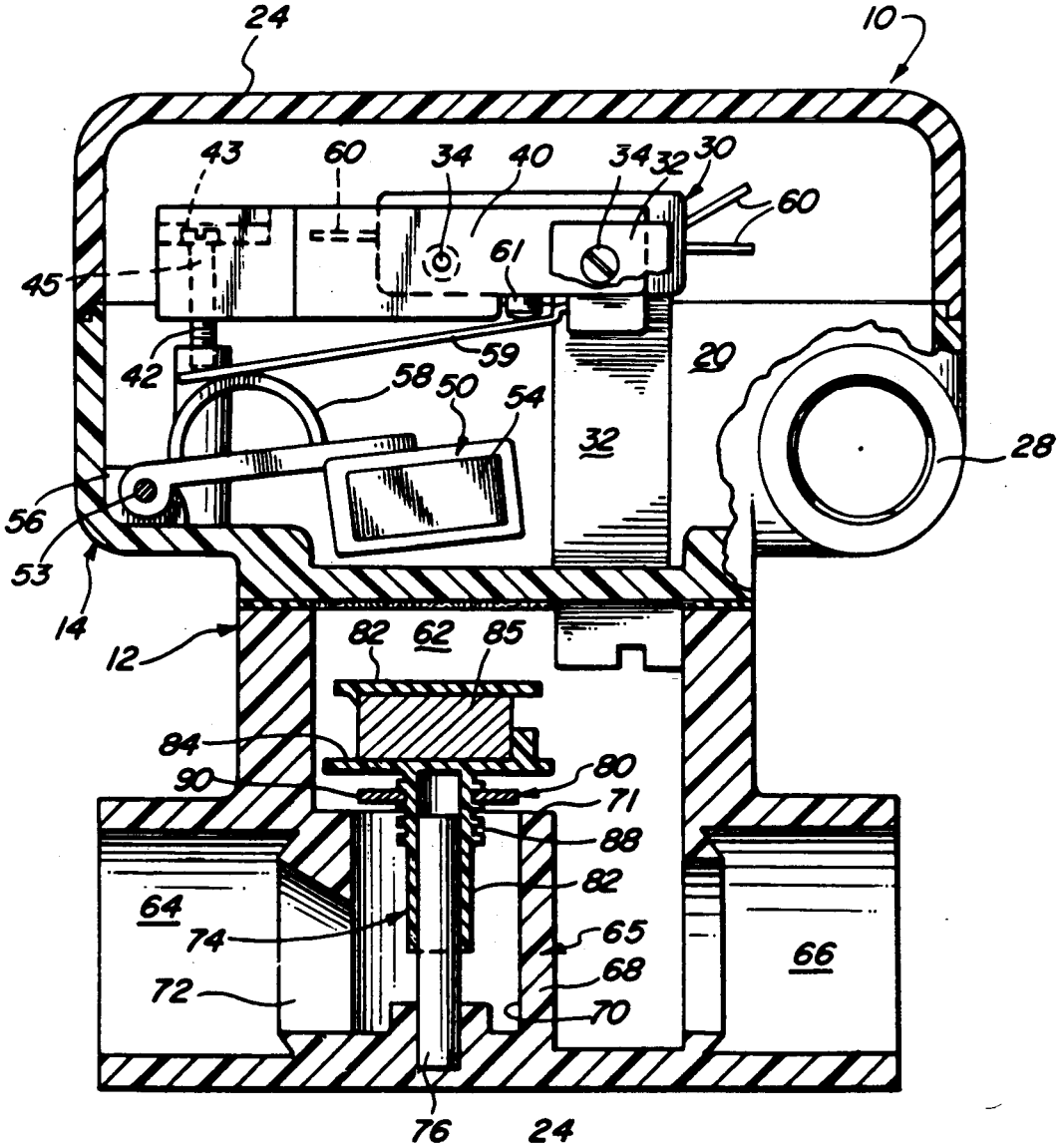
FIG. 1 is a cross-sectional view of the valve housing taken substantially along line 1—1 of FIG. 3 showing the arrangement of parts therein.
Figure 2:
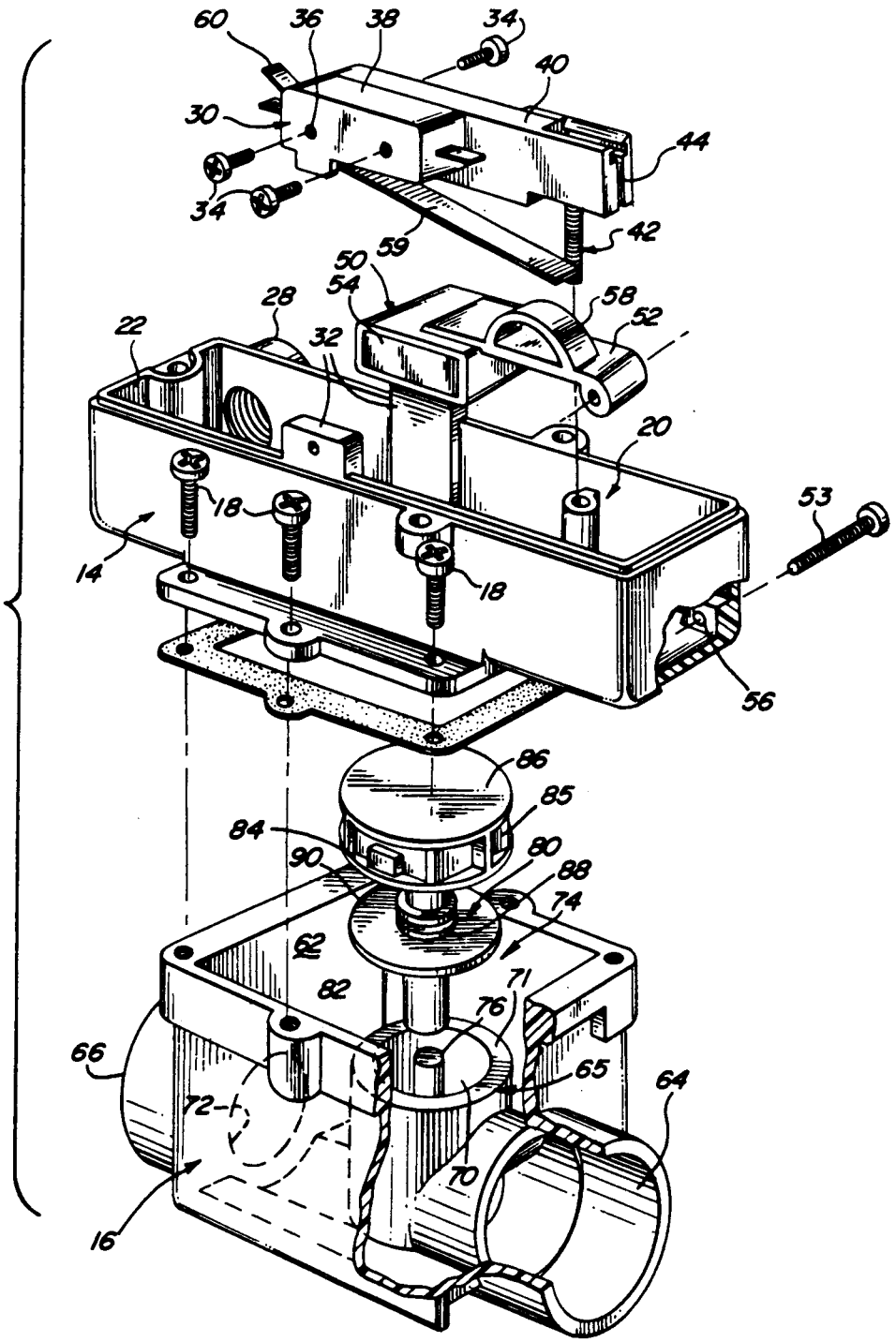
FIG. 2 is an exploded view thereof.

As particularly shown in FIG. 1, switch means 30 is pivotally mounted between a pair of post members 32 formed on opposite sides of box member 22. Post members 32 are also shown in the exploded view of FIG. 2 along with a pair of pivot screws or pins 34. These pins are mounted in post members 32 so as to be received into a transverse bore 36 disposed in switch body 38 of switch means 30. Secured to switch body 38 is a lever arm 40 that extends longitudinally outwardly from switch 38. Lever arm 40 is formed having an adjustable means 42 mounted thereon. Various arrangements of adjusting means are contemplated. However, the adjusting means shown herein is formed by a screw 42 slidably supported in a "T" shaped slot 44, as seen in FIG. 2, with head 43 of screw 42 being receiving in the horizontal slot section, and screw stem 45 being positioned within the vertical slot of "T" slot 44. The stem of screw 42 is threadably received in post 46 which is formed inside of box member 22 as indicated in FIG. 1.

Thus, it can be seen that by adjusting screw 42 lever arm 40 can be raised or lowered, thereby causing switch body 38 to pivot upwardly or downwardly. Such pivotal movement will position switch arm 48 of switch 38 with respect to a magnetic actuating means, indicated generally at 50. Magnetic actuating means 50 comprises a pivotal cam arm 52 wherein one end thereof is pivotally attached to a pair of ear members 56 by screw pin 53. A magnet 54 is fixedly mounted to the the free end of cam arm 52, as shown both in FIGS. 1 and 2. There is a suitable protruding member, such as cam member 58, which is formed on cam arm 52 so as to engage switch arm 48. Accordingly, by adjusting the position of the "ON/OFF" switch 38 it can accommodate whatever operating device to which it is electrically attached by means of switch contacts 60 for the proper operation of a given water-treatment system.

The lower section 16 of housing 12 defines a fluid-flow chamber 62 having an inlet port 64 and outlet port 66. Preferably, inlet port 64 is mounted downstream of a suitable water-treatment system which is not shown herein. Accordingly, treated or sterile water flows through inlet port 64 into a poppet valve, generally indicated at 65. Poppet valve 65 is formed by an upright valve-body member 68 which defines a vertical bore 70 having a valve seat 71. Bore 70 includes an intermediate inlet port 72 that provides communication between valve body member 68 and inlet port 64 as shown in FIG. 1. Valve-body member 68 is positioned adjacent the inlet port 64 so as to be offset within chamber 62. This allows the vertically positioned valve stem 74 to be aligned directly below the pivoted magnet 54 which is located in compartment 20 of the upper section 14 of housing 12. Mounted within the center of bore 70 of valve member 68 is a vertically disposed valve pin 76 which is adapted to receive slidable valve stem 74, which also defines part of a fluid-control means, generally designated at 80.

Thus, valve stem 74 is formed having a sleeve member 82 that is arranged to receive fixed valve pin 76. The upper open end of sleeve 82 is adapted to be closed by a valve plate 84 which is provided with a proper diameter so that when engaging valve seat 71 it will completely cover the open end of valve member 68 to prevent the back flow of treated water from being contaminated by the untreated water upstream of inlet port 64. Valve plate 84 is further provided with a housing 86 that is arranged to support a second magnet 85. Accordingly, second magnet 85 is aligned directly under magnet 54. It thus can be understood that the perpendicular movement of valve stem 74 will cause the attached magnet 85 to be raised or lowered as the case may be. It can also be seen that such up-and-down movement of the second magnet 85 will affect the pivotal movement of magnetic actuating means 50. This in turn causes switch 30 to be activated between an "Off" mode and an "On" mode of operation. That is, when second magnet 85 is in an up position, as seen in FIG. 1, the magnetic force therefrom will either repel the magnetic force of magnet 54, if the poles are alike, or attract it, if the poles are of opposite from each other.

Therefore, if both magnets have identical poles facing each other, magnet 54 will move in an upward direction, causing arm 52 to pivot upwardly, too. This in turn will force cam member 58 to engage switch arm 59, causing it to move switch button 61. Hence, the operation of a given treatment system will dictate the use of a normally "Closed" or a normally "Open" type switch.

As hereinbefore mentioned, the water flow through chamber 62 is determined by calibration means 80. The calibration means is shown as comprising stem 82 that is formed having a plurality of annular grooves 88 to which is removably mounted a calibrated washer 90. The washer is molded or formed preferably from a semi-flexible elastomer material so that it can be stretched over the annular rings that define grooves 88. When calibrating the fluid flow through poppet valve 65, the calibrating can be done in several ways. One way is to use different diameter washers, and another way is to position a particular size washer on one of the vertically positioned annular grooves 88. Thus, water flowing into inlet 64 is diverted upward through poppet valve 65 into chamber 62 by forcing valve stem 74 upwardly as the water flow pushes against the selected calibrated washer 90.

As an example, when a normally "Open" switch 30 is required to activate a particular device, such as a purifier, the two magnets are arranged so as to repel each other, causing cam arm 52 to pivot upwardly at the desired flow setting, thereby activating switch 30 to close and thus causing the purifier to operate.

What I claim is:

1. A magnetically controlled fluid-flow-switch valve device, comprising:

a housing having an independent upper section and an independent lower section, said upper section defining a switch compartment and said lower section defining a fluid-flow chamber having an inlet port and an outlet port;

a switch means positioned in said compartment of said upper section, wherein said switch means includes a first magnet;

a one-way valve means located in said fluid-flow chamber of said lower section;

a second magnet mounted to said one-way valve means and located within said chamber of said lower section and positioned so as to be juxtaposed with said first magnet disposed in said compartment of said upper section, wherein the movement of said second magnet moves said first magnet to activate said switch means;

calibration means adjustably attached to said one-way valve means, whereby the rate of fluid flow passing through said valve means and said chamber is adjustably selected for a given operation therewith;

wherein said one-way valve means comprises;

a poppet valve having a valve body member defining a valve seat;

a valve stem having a valve plate for engagement with said valve seat; and wherein said calibration means is mounted to said valve stem below said valve plate thereof and said second magnet is attached to said valve plate.

2. A fluid-flow-switch valve device as recited in claim 1, wherein said switch means comprises a switch that is adjustably mounted in said compartment and wherein said first magnet thereof is pivotally mounted in a pivot arm having a cam member positioned thereon for actuating engagement with said switch.

3. A fluid-flow-switch valve device as recited in claim 2, wherein said valve stem is slidably mounted on a valve pin perpendicularly positioned within said valve body, whereby said valve stem and said second magnet move vertically up or down on said valve pin so as to move said second magnet and said cam member with said pivot arm.

4. A fluid-flow-switch valve device as recited in claim 3, wherein said calibration means comprises a plurality of annular grooves formed in said valve stem below said valve plate and including a calibrated washer adjustably mounted in one of said grooves so as to be moved in and out of said valve body, said washer having a calibrated setting to control the rate of fluid flow through said chamber.

5. A fluid-flow-switch valve device as recited in claim 4, wherein said switch means includes means for adjusting the position of said switch.

6. A fluid-flow-switch valve device as recited in claim 5, wherein said switch is secured to said switch-adjusting means which comprises a lever arm having one end pivotally fixed within said compartment of said upper section and an oppositely disposed free end, said free end having a "T" slot formed therein to slidably receive a screw that is threadably attached to said upper section thereof.

* * * * *